US009863069B2

(12) United States Patent
Harabayashi

(10) Patent No.: US 9,863,069 B2
(45) Date of Patent: Jan. 9, 2018

(54) HOLLOW-WEAVE GROUND FABRIC

(71) Applicant: SUMISHO AIRBAG SYSTESMS CO., LTD., Matsuura-shi, Nagasaki (JP)

(72) Inventor: Teppei Harabayashi, Matsuura (JP)

(73) Assignee: SUMISHO AIRBAG SYSTEMS CO., LTD., Matsuura-Shi (JP)

( * ) Notice: Subject to any disclaimer, the term of this patent is extended or adjusted under 35 U.S.C. 154(b) by 0 days.

(21) Appl. No.: 15/129,747

(22) PCT Filed: Mar. 17, 2015

(86) PCT No.: PCT/JP2015/057858
§ 371 (c)(1),
(2) Date: Sep. 27, 2016

(87) PCT Pub. No.: WO2015/146707
PCT Pub. Date: Oct. 1, 2015

(65) Prior Publication Data

US 2017/0130371 A1 May 11, 2017

(30) Foreign Application Priority Data

Mar. 28, 2014 (JP) ..... 2014-068827

(51) Int. Cl.
*D03D 11/02* (2006.01)
*D03D 11/00* (2006.01)
*D03D 1/02* (2006.01)

(52) U.S. Cl.
CPC ..... *D03D 1/02* (2013.01); *D03D 11/00* (2013.01); *D03D 11/02* (2013.01); *D10B 2505/124* (2013.01)

(58) Field of Classification Search
CPC ..... D03D 1/02; D03D 11/02; D03D 11/00; B60R 21/235; B60R 2021/23547;
(Continued)

(56) References Cited

U.S. PATENT DOCUMENTS 5,692,777 A * 12/1997 Tochacek ..... B60R 21/235 280/743.1
5,863,644 A * 1/1999 Bonigk ..... D02G 3/402 139/383 A
(Continued)

FOREIGN PATENT DOCUMENTS

EP 1 669 481 A1 6/2006
JP 2003-267176 A 9/2003
(Continued)

OTHER PUBLICATIONS

Extended European Search Report dated May 12, 2017 for Application No. 15769622.0.
(Continued)

*Primary Examiner* — Bobby Muromoto, Jr.
(74) *Attorney, Agent, or Firm* — Birch, Stewart, Kolasch & Birch, LLP

(57) ABSTRACT

A junction band with high tensile strength in order to suppress rupture of a ground fabric from the junction band. Provided is a hollow-weave base fabric that includes a hollow-weave section (111) with a dual layer structure containing a first fabric layer and a second fabric layer, and a junction band (112) formed continuously from threads which form the hollow-weave section. The junction band comprises a first junction structure section (121), in which a structure of two layers is formed by the alternating positional relationship of a first continuation thread that extends from the first fabric layer of the hollow-weave section to the first junction structure section and a second continuation thread that extends from the second fabric layer of the hollow-weave section to the first junction structure section. The first junction structure section comprises at least one free perpendicular thread (400, 400') within the two-layer structure of the first junction structure section, and the free perpendicular thread extends in a direction perpendicular to
(Continued)

the first continuation thread and the second continuation thread and does not form part of the structure of two layers of the first junction structure section.

6 Claims, 7 Drawing Sheets

(58) Field of Classification Search
CPC ..... B60R 2021/23509; B60R 2021/23542; B60R 21/231
See application file for complete search history.

(56) References Cited

U.S. PATENT DOCUMENTS

| | | | | |
|---|---|---|---|---|
| 8,114,792 | B2 * | 2/2012 | Kuang | D03D 11/02 442/203 |
| 9,403,502 | B2 * | 8/2016 | Tanaka | B60R 21/235 |
| 2005/0130520 | A1 * | 6/2005 | Mouri | D03D 1/02 442/59 |
| 2005/0200108 | A1 * | 9/2005 | Keshavaraj | B60R 21/231 280/743.1 |
| 2006/0128244 | A1 * | 6/2006 | Hill | B32B 5/024 442/203 |
| 2007/0007756 | A1 * | 1/2007 | Okuno | B60R 21/235 280/743.1 |
| 2007/0200329 | A1 * | 8/2007 | Ma | B60R 21/231 280/743.1 |
| 2008/0042413 | A1 | 2/2008 | Coleman et al. | |
| 2008/0302438 | A1 * | 12/2008 | Sollars, Jr. | B60R 21/235 139/410 |
| 2010/0260976 | A1 * | 10/2010 | Kano | B60R 21/235 428/172 |
| 2015/0151710 | A1 * | 6/2015 | Tanaka | B60R 21/235 280/743.2 |
| 2017/0130371 | A1 * | 5/2017 | Harabayashi | D03D 11/02 |

FOREIGN PATENT DOCUMENTS

| | | |
|---|---|---|
| JP | 2005-105437 A | 9/2003 |
| WO | 2005/031052 A1 | 4/2005 |

OTHER PUBLICATIONS

International Search Report issued in PCT/JP2015/057858, dated Jun. 16, 2015.

* cited by examiner

| | CROSS-SECTIONAL SCHEMATIC VIEW | TENSILE STRENGTH [N/50mm] |
|---|---|---|
| EXAMPLE 1 |  | 1733 |
| EXAMPLE 2 |  | 1746 |
| COMPARATIVE EXAMPLE 1 |  | 1289 |
| COMPARATIVE EXAMPLE 2 |  | 1494 |

HOLLOW-WEAVE GROUND FABRIC

TECHNICAL FIELD

The present invention relates to a hollow-weave ground fabric, and more particularly relates to a hollow-weave ground fabric that requires high tensile strength in a junction band.

BACKGROUND ART

Most of the passenger automobiles produced today incorporate so-called airbags. The airbags are used to secure safety of passengers by rapidly expanding bag bodies between the passengers of an automobile and an in-vehicle structure of the automobile when the automobile collides with another automobile or with obstacles or when the automobile side-slips. Such airbags have high internal pressure caused by the gas generated from an inflator. In order to prevent destruction of an airbag material due to the pressure, the material with necessary and sufficient strength needs to be used in an appropriate manner. Particularly, when a one-piece woven (OPW) hollow-weave ground fabric is used for airbags or component members of the airbags such as gas hoses, rupture may occur at a junction band. As one of the solutions to the rapture of the ground fabric from the junction band, enhanced tensile strength of the junction band is required.

Conventionally, a junction band fabricated by a method in Patent Document 1 is known as the junction band of a hollow-weave ground fabric with high tensile strength. However, the method of Patent Literature 1 has been developed from a viewpoint of air leakage suppression or reduction in wrinkle generation, and therefore it is hard to find a specific description of the method from a viewpoint of tensile strength. There are also cases where tensile strength of the junction band is insufficient even when the method of Patent Literature 1 is performed.

CITATION LIST

Patent Literature

PATENT LITERATURE 1: JP-A-2005-105437

SUMMARY OF INVENTION

Technical Problem

Accordingly, an object of the present invention is to provide a junction band with high tensile strength in order to suppress rupture of a ground fabric from the junction band.

Solution to Problem

In order to accomplish the above object, the present invention is a hollow-weave ground fabric including: a hollow-weave section with a dual-layer structure composed of a first fabric layer and a second fabric layer; and a junction band continuously formed with threads that form the hollow-weave section, in which the junction band includes a first junction structure section, the first junction structure section being disposed immediately next to the hollow-weave section, the first junction structure section having a structure of two layers formed by reversing positional relationship between first continuous threads that extend from the first fabric layer of the hollow-weave section to the first junction structure section and second continuous threads that extend from the second fabric layer of the hollow-weave section to the first junction structure section, the first junction structure section having at least one free perpendicular thread within the structure of two layers in the first junction structure section, the free perpendicular thread extending in a direction perpendicular to the first continuous threads and the second continuous threads without forming part of the structure of two layers in the first junction structure section.

In another embodiment of the present invention, the junction band further includes a second junction structure section, the second junction structure section being disposed next to the first junction structure section in order from the hollow-weave section, the second junction structure having a single-layer structure.

In another embodiment of the present invention, the first junction structure section includes at least one first weave texture section and at least one second weave texture section, in the first weave texture section, the positional relationship between the first continuous threads and the second continuous threads is reversed, in the second weave texture section, all the first continuous threads are on the side of the second fabric layer with respect to the free perpendicular thread, while all the second continuous threads are on the side of the first fabric layer with respect to the free perpendicular thread, and the second junction structure section includes a third weave texture section, the third weave texture section having a single-weave texture.

In another embodiment of the present invention, in the first weave texture section, a number of formation perpendicular threads perpendicular to the first continuous threads and the second continuous threads to form a fabric layer is in a range of two to six, while in the second weave texture section, the number of the free perpendicular threads is six or less.

In another embodiment of the present invention, in the third weave texture section, the number of the formation perpendicular threads perpendicular to the first continuous threads and the second continuous threads to form a fabric layer is 16 or less, and in the weave texture forming the third weave texture section, the first continuous threads and the second continuous threads are alternately interchanged in a direction opposite to each other with respect to every two of the formation perpendicular threads.

Here, the continuous thread refers to a thread continuously extending from the hollow-weave section to the junction band. The first continuous thread refers to a continuous thread continuously extending from the first fabric layer of the hollow-weave section to the junction band. The second continuous thread refers to a continuous thread continuously extending from the second fabric layer of the hollow-weave section to the junction band. The perpendicular thread refers to a thread perpendicular to the continuous threads. The formation perpendicular thread refers to a perpendicular thread that forms the fabric layer of each section. The free perpendicular thread refers to a perpendicular thread that does not form the fabric layer.

DESCRIPTION OF EMBODIMENT

Hereinafter, a preferred embodiment of the present invention will be described with reference to the accompanying drawings. Articles indicated herein, including a weave structure, a weave texture, and the name and form of the weave texture in particular, are given merely for easy understanding of the gist of the present invention, and thus are not limitative of the embodiment of the present invention.

The weave structure of the present invention is applicable to some or all the junction bands of hollow-weave ground fabrics, and thus is applicable to junction bands having various shapes, such as junction bands continuing with an angle relative to wefts or warps, junction bands arranged to be curved, and twisted junction bands. In the case of using the weave structure of the present invention for airbags in particular, the weave structure is preferably applied to a portion on which stress is concentrated due to internal pressure.

Figure 1:
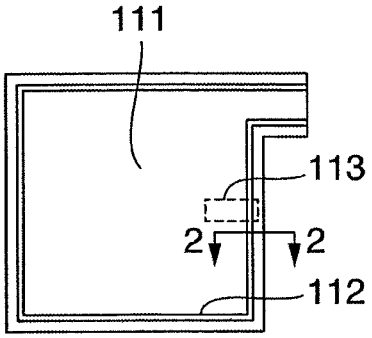
FIG. 1 illustrates one example of the configuration of an expandable hollow-weave ground fabric.

FIG. 1 illustrates one example of the configuration of an expandable hollow-weave ground fabric. The expandable hollow-weave ground fabric includes an expandable hollow-weave section 111 with a dual-layer structure and a junction band 112 disposed in an outer edge portion of the hollow-weave section 111.

Figure 2:
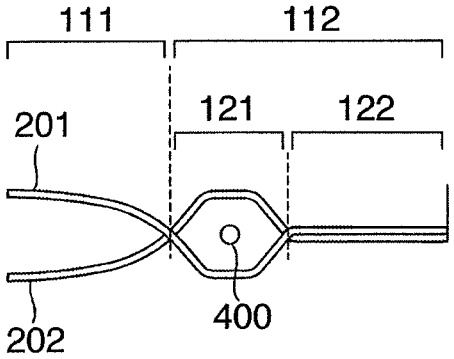
FIG. 2 is a schematic cross-sectional view conceptually illustrating one example of the present invention.

FIG. 2 is a schematic cross-sectional view conceptually illustrating one embodiment of the present invention as viewed along a line 2-2 of FIG. 1. The hollow-weave ground fabric of the present invention includes the hollow-weave section 111 with the dual-layer structure composed of a first fabric layer 201 and a second fabric layer 202, and the junction band 112 continuously formed with threads that form the hollow-weave section 111. The junction band includes a first junction structure section 121. The first junction structure section is disposed immediately next to the hollow-weave section. The first junction structure section has a structure of two layers formed by reversing positional relationship between first continuous threads that extend from the first fabric layer of the hollow-weave section 111 to the first junction structure section and second continuous threads that extend from the second fabric layer of the hollow-weave section to the first junction structure section.

The first junction structure section has at least one free perpendicular thread 400 within the structure of two layers in the first junction structure section. The free perpendicular thread extends in a direction perpendicular to the first continuous thread and the second continuous thread without forming part of the structure of two layers in the first junction structure section.

The junction band 112 further includes a second junction structure section 122. The second junction structure section 122 is disposed next to the first junction structure section 121 in order from the hollow-weave section 111, the second junction structure section having a single-layer structure. In place of the second junction structure section 122, another hollow-weave section may be formed.

Figure 3:
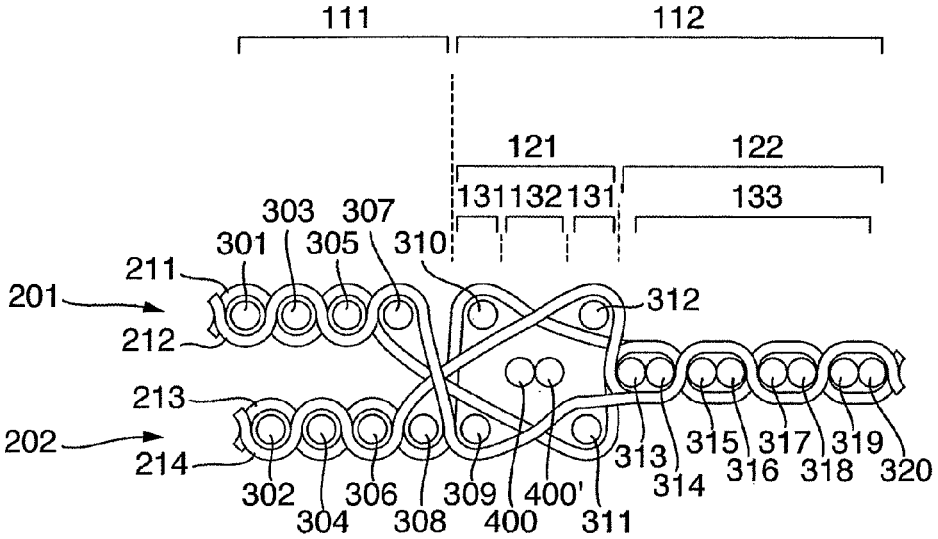
FIG. 3 illustrates one example of the present invention.

FIG. 3 is a schematic cross-sectional view more specifically illustrating FIG. 2 which is a conceptual view illustrating one embodiment of the present invention.

The hollow-weave ground fabric of the present invention includes: the hollow-weave section 111 with a dual-layer structure composed of the first fabric layer 201 and the second fabric layer 202; and the junction band 112 continuously formed with threads that form the hollow-weave section 111. The junction band includes the first junction structure section 121. The first junction structure section is disposed immediately next to the hollow-weave section. The first junction structure section 121 has a structure of two layers formed by reversing positional relationship between first continuous threads 211 and 212 that extend from the first fabric layer of the hollow-weave section 111 to the first junction structure section and second continuous threads 213 and 214 that extend from the second fabric layer of the hollow-weave section to the first junction structure section.

The first fabric layer 201 includes formation perpendicular threads 301, 303, 305, and 307 extending in a direction perpendicular to the first continuous threads 211 and 212 to form a fabric layer. The first continuous threads 211 and 212 and the formation perpendicular threads 301, 303, 305, and 307 constitute a weave texture of the first fabric layer 201. Similarly, the first fabric layer 202 includes formation perpendicular threads 302, 304, 306, and 308 extending in the direction perpendicular to the second continuous threads 213 and 214 to form a fabric layer. The second continuous threads 213 and 214 and the formation perpendicular threads 302, 304, 306, and 308 constitute a weave texture of the second fabric layer 202.

The hollow-weave section 111 may be configured into a bag shape as illustrated in FIG. 1. In this case, the hollow-weave section 111 can be expanded by such a method as introducing fluid, such as gas, to the inside of the hollow-weave section 111. The hollow-weave section 111 may be configured so that an end portion of the junction band opposite to the side of the hollow-weave section 111 is an open end. In this case, it is possible to expand and spread the fabric of separated two layers.

The structure of two layers is a structure having two separatable fabric layers formed by reversing positional relationship between the first continuous threads 211, 212 and the second continuous threads 213, 214. The structure of two layers extends over a range 121 between a point on the side of the hollow-weave section and a point on the side of an anti-hollow-weave section, the points being defined as the locations where any one of the continuous threads that form two fabric layers first appears on an external surface side of one layer opposite to the other layer formed by the same thread.

For example, in FIG. 3, the continuous thread 211 that forms a lower fabric layer, out of two fabric layers, appears on the external surface side of an upper layer opposite to the lower fabric layer in the range from the point between the formation perpendicular threads 305 and 307 to the point between the formation perpendicular threads 311 and 313. The continuous thread 212 that forms the lower fabric layer, out of two fabric layers, appears on the external surface side of the upper layer opposite to the lower fabric layer in the range from the point between the formation perpendicular threads 307 and 310 to the point between the formation perpendicular threads 314 and 315. The continuous thread 213 that forms the upper fabric layer, out of two fabric layers, appears on the external surface side of the lower layer opposite to the upper fabric layer in the range from the point between the formation perpendicular threads 308 and 309 to the point between the formation perpendicular threads 314 and 315. The continuous thread 214 that forms the upper fabric layer, out of two fabric layers, appears on the external surface side of the lower layer opposite to the upper fabric layer in the range from the point between the formation perpendicular threads 306 and 308 to the point between the formation perpendicular threads 312 and 313. On the hollow-weave section side as viewed from the two fabric layers, the point where any one of the continuous threads 211, 212, 213, and 214 first appears on the external surface side of one layer opposite to the other layer formed by the same thread is located between the formation perpendicular threads 308 and 309. On the anti-hollow-weave section side as viewed from the two fabric layers, the point where any one of the continuous threads 211, 212, 213, and 214 first appears on the external surface side of one layer opposite to the other layer formed by the same thread is located between the formation perpendicular threads 311 and 313 or the formation perpendicular threads 312 and 313. The structure of two layers extends over the range defined by these points on both the sides.

The first junction structure section 121 has at least one free perpendicular thread or threads 400, 400' within the structure of two layers in the first junction structure section 121. The free perpendicular thread extends in a direction perpendicular to the first continuous threads and the second continuous threads without forming part of the structure of two layers in the first junction structure section.

A total value of thickness or fineness of the free perpendicular thread or threads 400 and 400' is preferably not significantly different from a total value of thickness or fineness of the formation perpendicular threads 309, 310, 311, and 312. The total value of thickness or fineness of the free perpendicular thread or threads 400 and 400' is preferably in the range of 10% to 200% of the total value of thickness or fineness of the formation perpendicular threads 309, 310, 311, and 312, and is more preferably in the range of 20% to 150%.

The junction band for use in the hollow-weave ground fabric of the present invention may be formed not as a single junction structure section but as a combination of two or more junction structure sections. When the junction band is composed of two or more junction structure sections, the second junction structure section 122, which is second from the hollow-weave section side, preferably has a single-layer structure.

Figure 4:
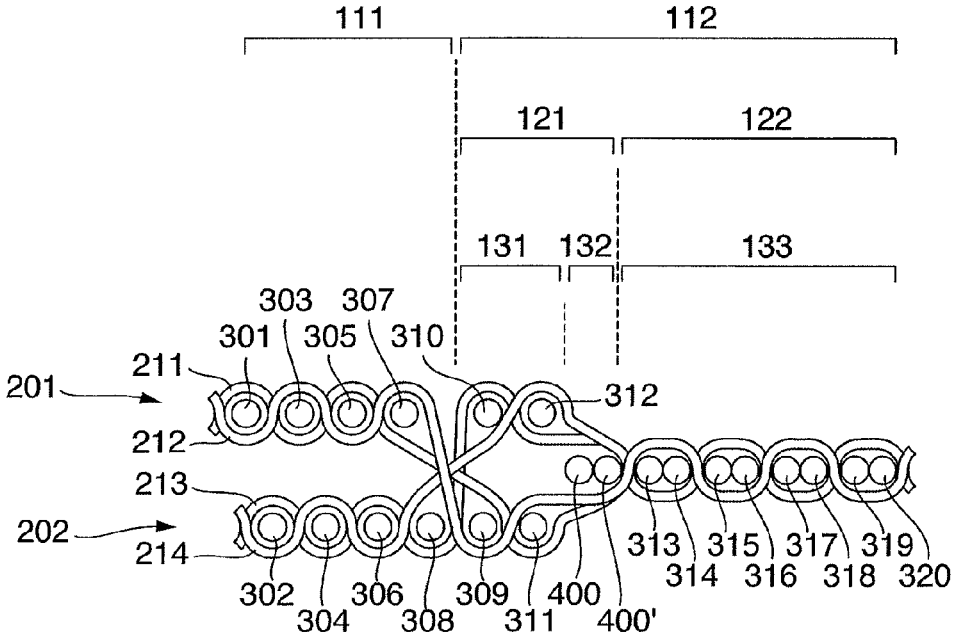
FIG. 4 illustrates another example of the present invention.

FIG. 4 illustrates another example of the present invention. According to the example of FIG. 4, the first junction structure section 121 includes at least one first weave texture section 131 and at least one second weave texture section 132. In the first weave texture section 131, positional relationship between the first continuous threads 211 and 212 and the second continuous threads 213 and 214 is reversed to form a hollow-weave texture. The weave texture of each layer of the hollow-weave texture may be any weave texture as long as the weave texture has a crossing degree necessary for formation of each fabric layer. Preferably, the weave texture of each layer is a plain weave, mat weave, or a rib weave with continuous threads. More preferably, the weave texture of each layer is the plain weave with the highest crossing degree.

In the second weave texture section 132, all the first continuous threads 211 and 212 are on the side of the second fabric layer 202 with respect to the free perpendicular thread or threads 400 and 400', while all the second continuous threads 213 and 214 are on the side of the first fabric layer 201 with respect to the free perpendicular thread or threads 400 and 400'. The weave texture of the second weave texture section 132 may be any weave texture as long as such structure can be implemented. In accordance with thread use of the first continuous threads 211 and 212 and the second continuous threads 213 and 214, a plain weave, a mat weave, a ribs weave with continuous threads, or mixture of these weave textures may properly be used.

The second junction structure section includes a third weave texture section 133. The third weave texture section 133 is a single-weave texture. As viewed from the hollow-weave section side, the third weave texture section 133 is on the opposite side of the hollow-weave section across at least one first weave texture section 131 and at least one second weave texture section 132. As the weave texture of the third weave texture section 133, a tight weave texture (such as a plain weave, a rib weave with continuous threads, a 2/2 mat weave, and a 2/2 twill) which suppresses a yarn shift may preferably be used.

More preferably, a portion of the third weave texture section 133 closest to the hollow-weave section side is so structured that the first continuous threads 211 and 212 are on the first fabric layer side while the second continuous threads 213 and 214 are on the second fabric layer side. By adopting this weave texture, the first continuous threads 211 and 212 are interchanged with the second continuous threads 213 and 214 on a boundary between the first weave texture section 131 or the second weave texture section 132 and the third weave texture section 133. This enhances an effect of suppressing a yarn shift of the perpendicular threads 309, 310, 311, 312, 400, and 400' that form the first weave texture section 131 and/or the second weave texture section 132.

As the number of the perpendicular threads that are present in the first weave texture section 131 and the second weave texture section 132 increases, displacement of a boundary portion between the hollow-weave section 111 and the junction band 112 caused by the yarn shift becomes larger. Therefore, the number of the perpendicular threads that form the first weave texture section 131 is preferably in the range of two to six. Furthermore, the number of the perpendicular threads in the second weave texture section, i.e., the number of the free perpendicular thread or threads 400 and 400' is preferably six or less.

Furthermore, the number of the formation perpendicular threads that form the third weave texture section 133 is preferably 16 or less, and is more preferably ten or less. From a viewpoint of suppressing the yarn shift, the weave texture of the third weave texture section is so formed that the first continuous threads and the second continuous threads are alternately interchanged in a direction opposite to each other with respect to every two of the formation perpendicular threads 313 to 320.

The weave texture of the hollow-weave section for use in the hollow-weave ground fabric of the present invention may preferably be a plain weave because the plain weave can provide a dense structure and equability in physical characteristics and performance. However, the weave texture may also be a mat weave (basket weave), a lattice weave (rip stop weave), a twill weave, a rib weave, a leno weave, a mock leno weave, or a mixture of these weaves.

To fabricate the hollow-weave ground fabric of the present invention, a loom may properly be selected from various looms used for weaving general industrial fabrics. For example, a loom may be selected from a shuttle loom, a water jet loom, an air-jet loom, a rapier loom, a projectile loom, and the like.

Fiber threads that constitute the hollow-weave ground fabric of the present invention may be natural fibers, chemical fibers, inorganic fibers, or the like, and therefore is not particularly limited. Synthetic fiber filaments having general versatility are particularly preferable in respect of manufacturing process of the ground fabric, physical properties of the ground fabric, and the like. For example, one or more kinds of thread fibers may properly be selected from fibers such as: aliphatic polyamide fibers including Nylon 6, Nylon 66, Nylon 46, Nylon 610, and Nylon 612, or copolymers and mixtures of these; copolymer polyamide fibers of aliphatic amine and aromatic carboxylic acid represented by Nylon 6T, Nylon 6I, and Nylon 9T; polyester fibers including polyethylene terephthalate, polytrimethylene terphthalate, polybutylene terephthalate, and polyethylenenaphthalate, or copolymers and mixtures of these; ultrahigh molecular weight polyolefin-based fibers; chlorine-containing fibers including vinylene and polyvinyl chloride; fluorine-containing fibers including polytetrafluoroethylene; polyacetal-based fibers; polysulfone-based fibers; polyphenylene sulfide-based fibers (PPS); polyether ether ketone-based fibers (PEEK); wholly aromatic polyamide-based fibers; wholly aromatic polyester-based fibers; polyimide-based fibers; polyether imide-based fibers; poly para-phenylene benzobisoxazole-based fibers (PBO); vinylon-based fibers; acrylic fibers; cellulosic fibers; silicon carbide-based fibers; alumina-based fibers; glass-based fibers; carbon-based fibers; and steel-based fibers. Among these, Nylon 66 fibers, Nylon 6 fibers, and polyester-based fibers are preferable.

The thickness of each single thread used in the present invention may be identical to or different from each other, and is preferably in the range of 0.5 to 6 dtex, for example. The strength of each single thread to be used is 7 cN/dtex or more, and is preferably 8 cN/dtex or more. Furthermore, a sectional shape of each single thread may properly be selected from the group including round shapes, oval shapes, flat shapes, polygonal shapes, hollow shapes, and other different shapes without compromising fabric manufacturing and physical properties of fabrics. It is also possible to use a thread formed by integrating a plurality of threads different in fineness, sectional shape, and the like by doubling, twisting, or other processing.

In order to improve capabilities of the fiber threads such as spinnability, workability, and durability, one or more kinds of additives, out of various additives generally used, may be used. Examples of the additives include a heat-resistant stabilizer, an antioxidant, a light-resistant stabilizer, an age inhibitor, a lubricant, a smoothing agent, a pigment, a water-repellent agent, an oil-repellent agent, a masking agent such as titanium oxide, a luster imparter, a flame retarder, and a plasticizer. Moreover, treatment such as twisting, bulking, crimping, winding, and pasting may also be applied. Furthermore, the type of the threads to be used are not limited to long-fiber filaments but may include a staple spun thread and a composite thread thereof.

The physical properties of the fiber threads for use in the hollow-weave ground fabric of the present invention may properly be selected in accordance with required performance and purposes. In the case of using the hollow-weave ground fabric of the present invention for airbags, gas hoses and the like in particular, the fineness of warps and wefts of the hollow-weave ground fabric may be selected from the threads in a thickness range generally used in the ground fabrics for airbags, i.e., in the range of 150 to 1000 dtex, and may preferably be selected from the threads in the range of 235 to 700 dtex. When the fineness is smaller than 150 dtex, it tends to become difficult to obtain the strength required for airbags and gas hoses, whereas when the fineness is beyond 1,000 dtex, a unit weight tends to become too large.

Also in the case of using the hollow-weave ground fabric of the present invention for airbags, gas hoses and the like, a cover factor that is an index indicating the density of the weave structure is preferably 500 or more, and is more preferably 700 or more.

The cover factor (CF) is generally calculated as a product of weaving density N (number/cm) and thickness D (dtex) of warps and wefts of a hollow-weave ground fabric as expressed in a following expression:

$$CF=Nw\times\sqrt{Dw}+Nf\times\sqrt{Df}$$

where Nw and Nf are weaving density (number/cm) of warps and wefts, and Dw and Df are thickness (dtex) of warps and wefts.

Also in the case of using the hollow-weave ground fabric of the present invention for airbags, gas hoses and the like, it is preferable to impart an air-impermeable material to the hollow-weave ground fabric. As described hereinbelow, the air-impermeable material is, for example, a material that substantially inhibits passage of air. The material has air impermeability when a measurement value is zero in the measurement performed by method A (Frazier method) in 8.27.1 in JIS L1096 "Testing methods for woven and knitted fabrics". The material is imparted to one side or both sides of a fabric by a later-described method. The air-impermeable material may be put on any place such as the surface of the ground fabric, intersections of thread bundles that constitute the ground fabric, or gap portions between fiber single threads.

The material may be any material which is generally used as a ground fabric for airbags or a ground fabric for gas hoses and which has sufficient heat resistance, abrasion resistance, adhesion to the ground fabric, fire retardancy, imprint resistance, and the like. For example, one or more kinds of materials may be used which are selected from the group including silicone-based resin or rubber, polyurethane-based resin or rubber (including silicone-modified and fluorine-modified resin or rubber), fluorine-based resin or rubber, chlorine-based resin or rubber, polyester-based resin or rubber, polyamide-based resin or rubber, epoxy-based resin, vinyl-based resin, urea-based resin, and phenol-based resin. Silicone resin is preferable in particular in respect of heat resistance and fire retardancy.

Examples of a method for imparting include 1) coating method (including knife, kiss, reverse, comma, slot die, and lip coating), 2) impregnating method, 3) printing method (including screen, roll, rotary, and gravure printing), 4) transfer method (transfer), and 5) lamination method. Among these, the coating method or lamination method is preferable as they can effectively maintain internal pressure.

The amount of the material imparted to the fabric for use in airbags is preferably 10 to 150 g/m$^2$ for one side, and is more preferably 25 to 100 g/m$^2$. When the material is imparted as a layer, the thickness thereof is preferably 10 μm or more. When the imparted amount is less than 10 g/m$^2$ for one side, or when the layer thickness is thinner than 10 μm, it tends to become difficult to provide necessary airtightness.

In order to improve processability, adhesion, surface characteristics, or durability, not only a main material but also one or more kinds of additives may be selected from various additives which are generally used and be mixed into the material. Examples of the additives include a crosslinking agent, an adhesion imparting agent, a reaction accelerator, a reaction retarding agent, a heat-resistant stabilizer, an antioxidant, a light-resistant stabilizer, an age inhibitor, a lubricant, a smoothing agent, an anti-tack agent, a pigment, a water-repellent agent, an oil-repellent agent, a masking agent such as titanium oxide, a luster imparter, a flame retarder, and a plasticizer.

The type of the material as a liquid may properly be selected from the group including a non-solvent type, a solvent type, a water-dispersion type, a water-emulsifiable type, and a water soluble type, in accordance with an application amount, an application method, and required properties such as workability and stability of the material.

Various pretreatment agents to enhance adhesion to the ground fabric, bonding improvers, and the like may be added to the material, or pretreatment such as priming may be applied to the surface of the ground fabric in advance. Furthermore, in order to enhance physical characteristics of the material or to impart heat resistance, aging resistance, oxidation resistance, and the like to the material, treatment such as heat treatment, pressure heat treatment, and high energy treatment (such as high frequency, electron beam, and ultraviolet treatment) may be performed after the material is imparted to the fabric, so that drying, crosslinking, vulcanization, and the like are implemented.

In addition, a joint portion may be added by such methods as sewing, bonding, welding, and pressing, or cutting may be performed with metal blade, laser, and high-pressured fluid. When cutting processing is performed in particular, laser cutting processing is preferable since a cut surface is fused so that fraying can be suppressed.

EXAMPLES

Examples of the present invention will be illustrated below.

Measurement values were measured and accessed based on following criteria.

Cloth strength and ductility were measured three times with a testing machine TENSILON by A&D Company Ltd. under the conditions of 200 mm measurement length and 200 mm/min tension speed, and their average values were recorded.

Hollow-weave ground fabrics according to each of the embodiments and comparative examples were prepared to have a hollow-weave section with a two-layer plain weave texture, under the same conditions described below except for the structure of the junction band.

Preparation conditions: 470 dtex/72f Nylon-6.6 fibers with thread strength of 40 N/number and 21% ductility were sized with a polyacrylic acid sizing agent, and then were arranged so that 10,000 fibers were wound around a warp beam. Next, a hollow-weave ground fabric with a hollow-weave section and a junction band having a shape illustrated in FIG. 1 was weaved with 57 warps/inch and 49 wefts/inch by an air jet loom equipped with a jacquard device for warp control. Next, the fabric was soaked in aqueous solution containing 7.4 g/L sodium hydroxide at 60° C., put in a steam tank at 80° C. for 30 seconds, and then was water-washed for 1 minute at 90° C. After being dried for 1 minute with a heating roller at 100° C., the fabric was heat-set by a tenter at 150° C. for 30 seconds, and wound up.

Thus, the hollow-weave ground fabrics each having a junction band were structured according to each of the embodiments and comparative examples, and a sample including the junction band was cut out from each of the hollow-weave ground fabrics at a position 113 illustrated in FIG. 1, the sample having a width of 50 mm with the hollow-weave section being 100 mm in length. Then, the hollow-weave section in each sample was expanded to provide a test sample having the junction in center with a measurement length of 200 mm, and a tension test was performed on each of the test samples.

Example 1

Figure 5:
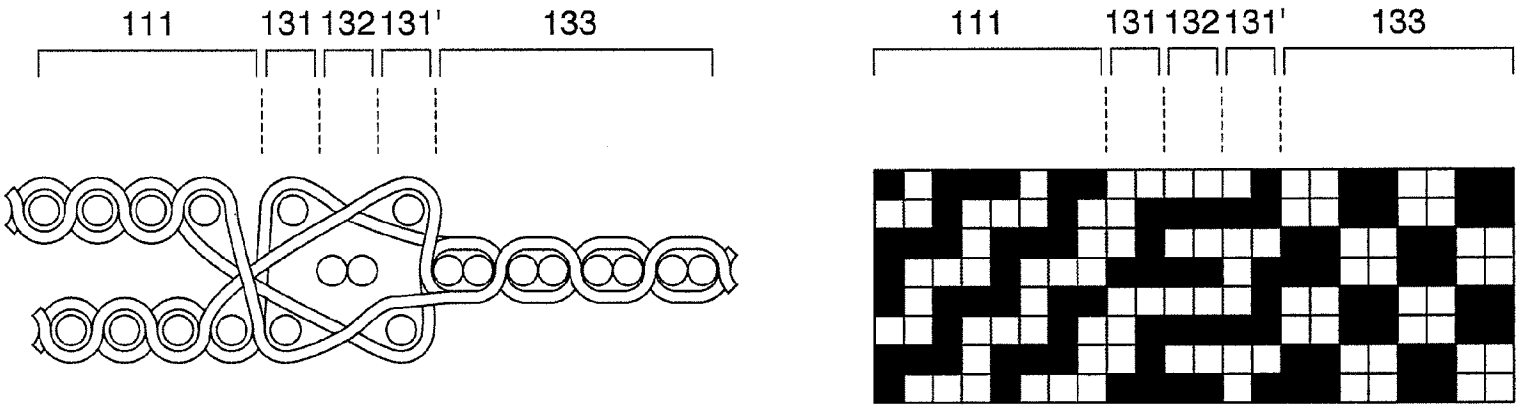
FIG. 5 illustrates a schematic cross-sectional view and a weave texture of example 1.

FIG. 5 illustrates a schematic cross-sectional view and a weave texture of example 1. In the junction band of example 1, weave textures were allotted to the first weave texture section, the second weave texture section, the first weave texture section, and the third weave texture section in this order from the hollow-weave section side. The first weave texture section had a two-layer plain weave texture with a width corresponding to one perpendicular thread in each layer. The second weave texture section had a rib weave texture with continuous threads having a width corresponding to two perpendicular threads. The third weave texture section had a 2/2 basket weave texture with a width corresponding to eight perpendicular threads.

Figure 9:
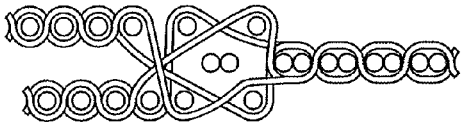
FIG. 9 illustrates test results of the examples and the comparative examples.
Figure 9:
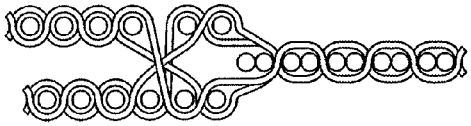
Figure 9:
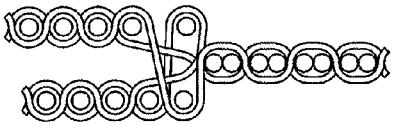
Figure 9:
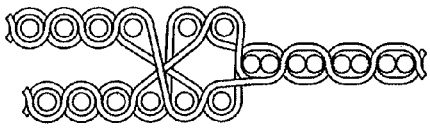

FIG. 9 illustrates results of tension tests. In example 1, sufficiently high tensile strength was confirmed.

Example 2

Figure 6:
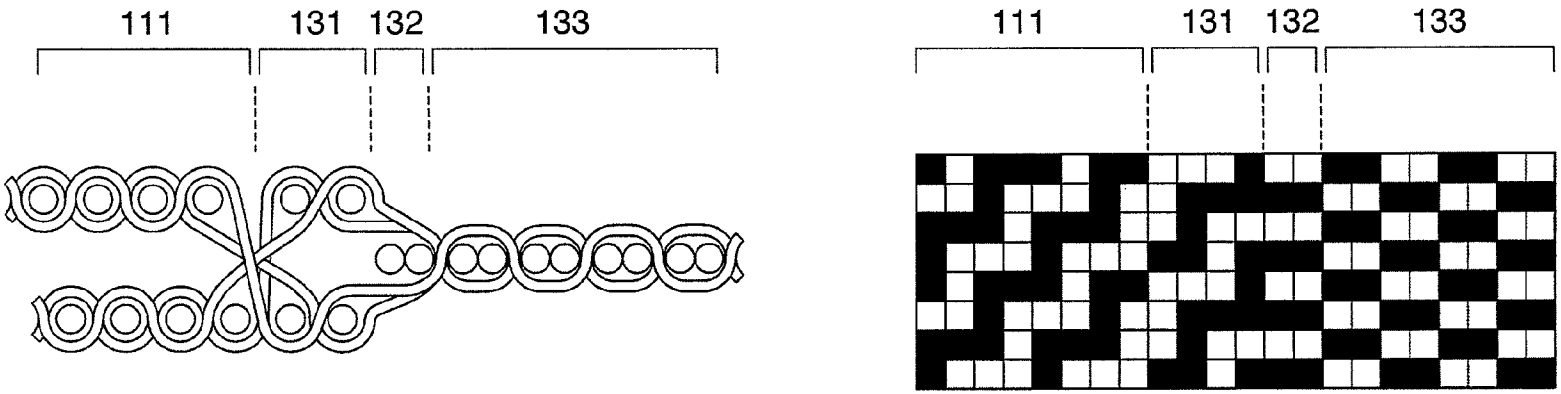
FIG. 6 illustrates a schematic cross-sectional view and a weave texture of example 2.

FIG. 6 illustrates a schematic cross-sectional view and a weave texture of example 2. In the junction band of example 2, weave textures were allotted to the first weave texture section, the second weave texture section, the first weave texture section, and the third weave texture section in this order from the hollow-weave section side. The first weave texture section had a two-layer plain weave texture with a width corresponding to two perpendicular thread in each layer. The second weave texture section had a rib weave texture with continuous threads having a width corresponding to two perpendicular threads. In the third weave texture section, eight formation perpendicular threads were used, and first continuous threads and second continuous threads were vertically interchanged in the boundary between the second weave texture section and the third weave texture section to fabricate a rib weave texture formed from continuous threads.

FIG. 9 illustrates results of the tension tests. In example 2, sufficiently high tensile strength was confirmed.

Comparative Example 1

Figure 7:
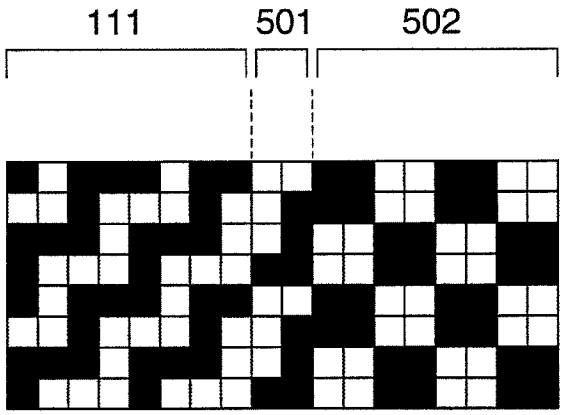
FIG. 7 illustrates a schematic cross-sectional view and a weave texture of comparative example 1.
Figure 7:
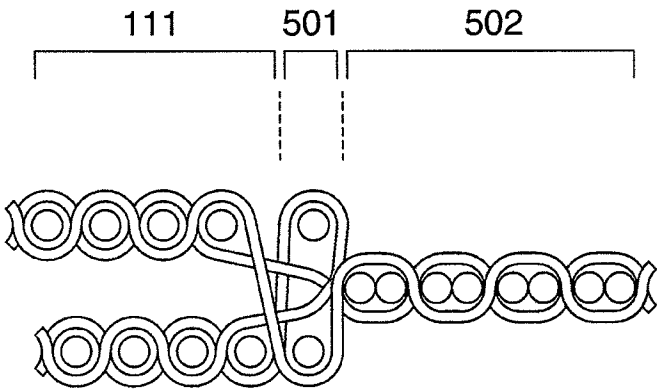

FIG. 7 illustrates a schematic cross-sectional view and a weave texture of comparative example 1. In the junction band of comparative example 1, weave textures were allotted to a two-layer plain weave texture 501 and a 2/2 basket weave texture 502 in this order from the hollow-weave section side. The two-layer plain weave texture 501 contained one perpendicular thread in each layer, and the first continuous threads and the second continuous threads were vertically interchanged. The 2/2 basket weave texture 502 contains eight perpendicular threads.

FIG. 9 illustrates results of the tension tests. In comparative example 1, the tensile strength was considerably lower than that in examples 1 and 2.

Comparative Example 2

Figure 8:
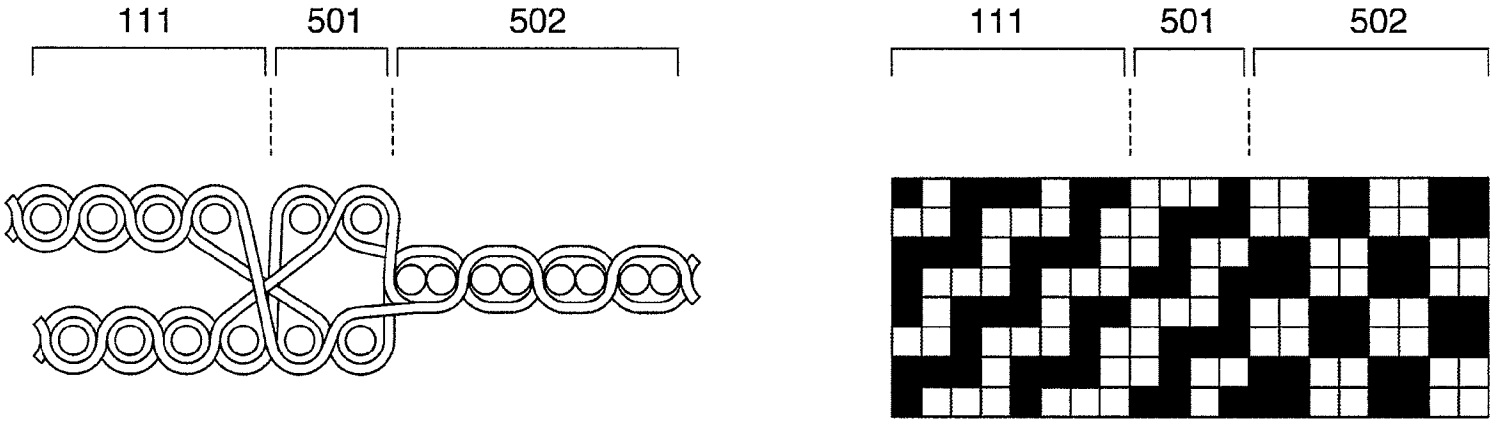
FIG. 8 illustrates a schematic cross-sectional view and a weave texture of a comparative example 2.

FIG. 8 illustrates a schematic cross-sectional view and a weave texture of comparative example 2. In the junction band of comparative example 2, weave textures were allotted to the two-layer plain weave texture 501 and the 2/2 basket weave texture 502 in this order from the hollow-weave section side. The two-layer plain weave texture 501 contained two perpendicular threads in each layer, and the first continuous threads and the second continuous threads were vertically interchanged. The 2/2 basket weave texture 50 contained eight perpendicular threads.

FIG. 9 illustrates results of the tension tests. The tensile strength in comparative example 2 was higher than that in comparative example 1, but was lower than that in the first and second examples.

As described in the foregoing, it was confirmed that the first and second examples had the junction band with tensile strength higher than that in the comparative examples.

As described in the foregoing, the present invention can provide the hollow-weave ground fabric having a junction band with high tensile strength. It becomes possible to provide the hollow-weave ground fabric capable of suppressing rupture from the junction band in a use involving high stress applied to the junction band and in a use where high-pressure fluid is introduced to the hollow-weave section as in the case of automobile airbags and component members of the automobile airbags such as gas hoses in particular.

REFERENCE SIGNS LIST

111 Hollow-weave section
112 Junction band
113 Range representing sampling area
121 First junction structure section
122 Second junction structure section
131, 131' First weave texture section
132 Second weave texture section
133 Third weave texture section
201 First fabric layer
202 Second fabric layer
211, 212 First continuous thread
213, 214 Second continuous thread
301-320 Formation perpendicular thread
400, 400' Free perpendicular thread
501 Two-layer plain weave texture
502 2/2 basket weave texture

The invention claimed is:

1. A hollow-weave ground fabric, comprising:

a hollow-weave section with a dual-layer structure composed of a first fabric layer and a second fabric layer; and a junction band continuously formed with threads that form the hollow-weave section, wherein the junction band includes a first junction structure section, the first junction structure section being disposed immediately next to the hollow-weave section, the first junction structure section having a structure of two layers formed by reversing positional relationship between first continuous threads that extend from the first fabric layer of the hollow-weave section to the first junction structure section and second continuous threads that extend from the second fabric layer of the hollow-weave section to the first junction structure section, the first junction structure section having at least one free perpendicular thread within the structure of two layers in the first junction structure section, the free perpendicular thread extending in a direction perpendicular to the first continuous threads and the second continuous threads without forming part of the structure of two layers in the first junction structure section.

2. The hollow-weave ground fabric according to claim 1, wherein the junction band further includes a second junction structure section, the second junction structure section being disposed next to the first junction structure section in order from the hollow-weave section, the second junction structure section having a single-layer structure.

3. The hollow-weave ground fabric according to claim 2, wherein the first junction structure section includes at least one first weave texture section and at least one second weave texture section, in the first weave texture section, the positional relationship between the first continuous threads and the second continuous threads is reversed, in the second weave texture section, all the first continuous threads are on the side of the second fabric layer with respect to the free perpendicular thread, while all the second continuous threads are on the side of the first fabric layer with respect to the free perpendicular thread, and the second junction structure section includes a third weave texture section, the third weave texture section having a single-weave texture.

4. The hollow-weave ground fabric according to claim 3, wherein in the first weave texture section, a number of formation perpendicular threads perpendicular to the first continuous threads and the second continuous threads to form a fabric layer is in a range of two to six, while in the second weave texture section, the number of the free perpendicular threads is six or less.

5. The hollow-weave ground fabric according to claim 3, wherein in the third weave texture section, the number of the formation perpendicular threads perpendicular to the first continuous threads and the second continuous threads to form a fabric layer is 16 or less, and in the weave texture of the third weave texture section, the first continuous threads and the second continuous threads are alternately interchanged in a direction opposite to each other with respect to every two of the formation perpendicular threads.

6. The hollow-weave ground fabric according to claim 4, wherein in the third weave texture section, the number of the formation perpendicular threads perpendicular to the first continuous threads and the second continuous threads to form a fabric layer is 16 or less, and in the weave texture of the third weave texture section, the first continuous threads and the second continuous threads are alternately interchanged in a direction opposite to each other with respect to every two of the formation perpendicular threads.

* * * * *